US005163829A

United States Patent [19]

Wildenberg

[11] Patent Number: 5,163,829

[45] Date of Patent: Nov. 17, 1992

[54] COMPACT REGENERATIVE INCINERATOR

[75] Inventor: Henry N. Wildenberg, Kaukauna, Wis.

[73] Assignee: Thermo Electron Wisconsin, Inc., Kaukauna, Wis.

[21] Appl. No.: 734,952

[22] Filed: Jul. 24, 1991

[51] Int. Cl.[5] ..... F23D 14/00; F23G 7/08; F23J 15/00

[52] U.S. Cl. ..... 431/5; 110/211; 110/213; 422/175; 431/170; 432/182

[58] Field of Search ..... 431/170, 5; 110/211, 110/212, 213; 432/181, 182; 422/170, 175

[56] References Cited

U.S. PATENT DOCUMENTS

| | | | |
|---|---|---|---|
| 3,170,680 | 2/1965 | Keefer . | |
| 3,692,096 | 9/1972 | Pettersson et al. . | |
| 3,870,474 | 3/1975 | Houston . | |
| 3,895,918 | 7/1975 | Mueller . | |
| 4,174,948 | 11/1979 | Bradley et al. . | |
| 4,239,479 | 12/1980 | Hodgkin . | |
| 4,311,456 | 1/1982 | Kletch . | |
| 4,358,268 | 11/1982 | Neville . | |
| 4,454,826 | 6/1984 | Benedick | 110/211 |
| 4,470,806 | 9/1984 | Greco | 432/182 |
| 4,474,118 | 10/1984 | Benedick | 110/211 |
| 4,604,051 | 8/1986 | Davies et al. . | |
| 4,650,414 | 3/1987 | Grenfell | 431/5 |
| 4,793,974 | 12/1988 | Hebrank . | |
| 4,819,571 | 4/1989 | Hallett . | |
| 4,828,483 | 5/1989 | Finke . | |
| 4,829,703 | 5/1989 | Watson et al. | 432/181 |
| 4,944,674 | 7/1990 | Wedge et al. . | |
| 4,974,530 | 12/1990 | Lyon . | |

OTHER PUBLICATIONS

Thermo Electron Product Literature for "Thermo Reactor Regenerative Incinerator".

*Primary Examiner*—Edward G. Favors
*Attorney, Agent, or Firm*—Fish & Richardson

[57] ABSTRACT

A compact regenerative incinerator for incinerating an effluent includes a single vessel with two compartments separated by a partition. Each compartment includes an opening and a combustion chamber, and these are separated by a thermal storage medium. The incinerator also has a bypass system, which includes a bypass opening in the vessel and a bypass thermal storage medium separating the opening from the combustion chambers. Valving, which includes one or more flushed control valves, directs the effluent to flow into one of the compartment openings and directs the products of incineration to flow out of the other. The valving is also adapted to direct the effluent into the bypass opening while reversing the flow direction in the incinerator. A controller monitors effluent concentration, its temperature and that of the products of incineration, as well as rates of temperature change, and uses the resulting information to reverse the flow direction at times which optimize efficacy for differing levels of delivery of effluent. A purging system recirculates a portion of the products of incineration during purging, and pressure is regulated so that the purging occurs within a set period of time.

22 Claims, 10 Drawing Sheets

COMPACT REGENERATIVE INCINERATOR

BACKGROUND OF THE INVENTION

The present invention is related to regenerative incinerator systems, particularly to those for use in incinerating effluents containing volatile hydrocarbons.

Various industrial processes, such as wood treatment, web offset printing, adhesive tape manufacturing and other coating operations, generate effluents containing volatile organic compounds, which may be toxic, photochemically reactive, or present an offensive odor, and whose concentrations may vary over time. Regenerative incinerators have been used to incinerate these waste vapors. Known regenerative incinerator designs include arrangements of cylindrical vessels containing a loosely packed material that serves as a thermal energy storage and transfer medium for gasses passing through it during the incineration process. Typical regenerative incinerators employ multiple vessels which are interconnected by way of ducts, which form a part of the combustion chamber. Such systems may be costly to fabricate and operate, as well as require large amounts of floor area to accommodate the multiple vessels.

SUMMARY OF THE INVENTION

In general, the invention features an improved method and apparatus for incinerating an effluent, such as gases containing vapors of volatile hydrocarbons. The compact regenerative incinerator includes a single vessel with an internal partition separating the vessel into two compartments. Each compartment includes an opening and a combustion chamber, and these are separated by a primary thermal storage medium. The combustion chambers preferably are interconnected through a swirl tube extending through a passage in the partition. The incinerator also has a bypass system, which includes an opening in the vessel and a bypass thermal storage medium separating the opening from the combustion chambers. Valving directs the effluent to flow into one of the openings and directs the products of incineration to flow out of the other. The valving is also adapted to direct the effluent into the bypass system while reversing the flow direction in the incinerator.

The incinerator preferably includes a controller to monitor effluent concentration, its temperature and that of the products of incineration, as well as rates of temperature change, and to use the resulting information to establish the time at which to reverse the flow direction. This may be done so as to optimize the efficacy of the incinerator for differing levels of delivery of effluent, and may be based on a computer model of the incinerator.

A purging system may be connected to the valving, and operate to recirculate a portion of the expelled products of incineration and direct them to purge one of the thermal recovery media and its associated combustion chamber prior to the reversing. An exhaust pressure balance damper regulates the pressure so as to perform purging within a set period of time. A portion of the products of incineration are recirculated to the exhaust fan before purging, so as to allow the fan to accelerate.

Essentially identical burners for each combustion chamber may be fired in parallel and burn at essentially identical energy input levels, and a real-time average temperature may be used in controlling the burners.

Liquid, ambient air, or other means may cool the exhaust fan if the temperature exceeds a predetermined value. The incinerator may include one or more flushed control valves.

The single vessel design of the invention has a significant impact on installed cost of the incinerator, due to reduced material and labor costs in its fabrication, and the small amount of floor space required for its installation. This, in turn, permits flexibility in the site selection process. The control valves which manage flow through the incinerator are located in one cluster either adjacent to the vessel or directly below it, to simplify connection to the effluent source, and to further reduce required floor space. Because the vessel has a low surface area, heat loss to the surroundings is reduced, for a system having a given flow rate capacity. Further, the resulting low number of external connection points reduces the potential for leakage.

The incinerator may accept effluent containing vapors at varying concentrations and flow rates, which may arise from one or more independent processes, while maintaining a high degree of thermal effectiveness. The split combustion chamber with swirl tube and parallel burners ensures that the effluent being treated uniformly reaches the proper incineration temperature and is held for the time duration required for thorough incineration of the effluent. The design of the swirl tube is such that the effluent is accelerated in speed and induced to swirl, resulting in a high amount of turbulence, which promotes more complete oxidation of the volatile organic compounds by stripping the products of combustion from the unburned hydrocarbons and allowing those hydrocarbons access to oxygen. The parallel burners allow for reduced gas consumption and prevent excessive amplitude of the individual chamber burning firing rates. The bypass system, purging system and double valves prevent leakage of untreated effluent from the incinerator, particularly during flow reversal. A second flush operation during valve changeover further improves leakage prevention The secondary mass of thermal storage medium adds heat to effluent brought into the vessel by way of the bypass system, preventing cooling of the effluent and improving clean up efficiency. An exhaust duct back-pressure valve allows for consistent and timely purging during flow reversal A "tee" damper allows for stabilization of the fan flow before flow reversal to prevent a reduction in flow of effluent during flushing. The exhaust fan is protected from excessive temperature, which might otherwise cause damage.

DETAILED DESCRIPTION

Figure 1:
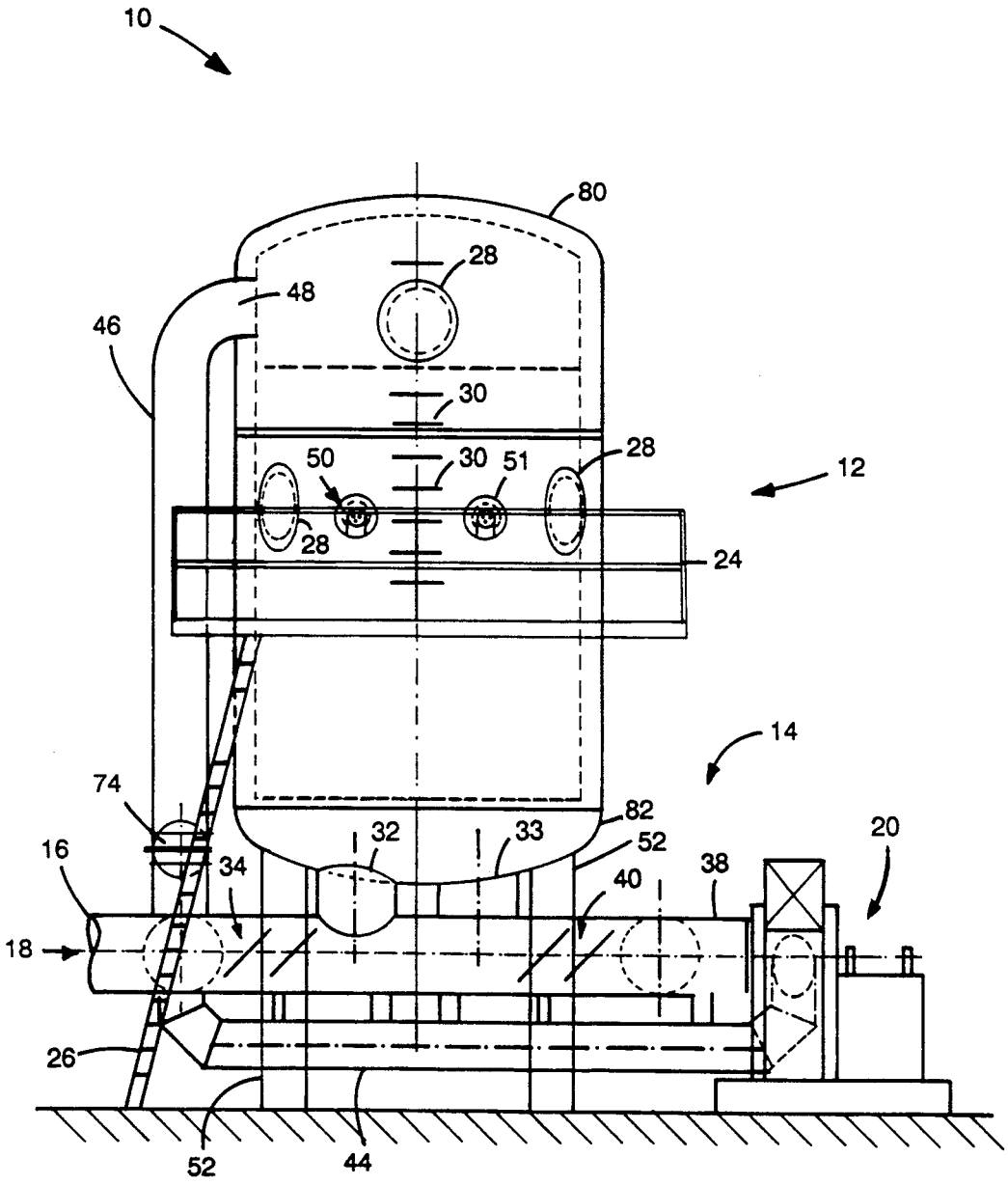
FIG. 1 is a front elevation of the compact regenerative incinerator of the invention.
Figure 2:
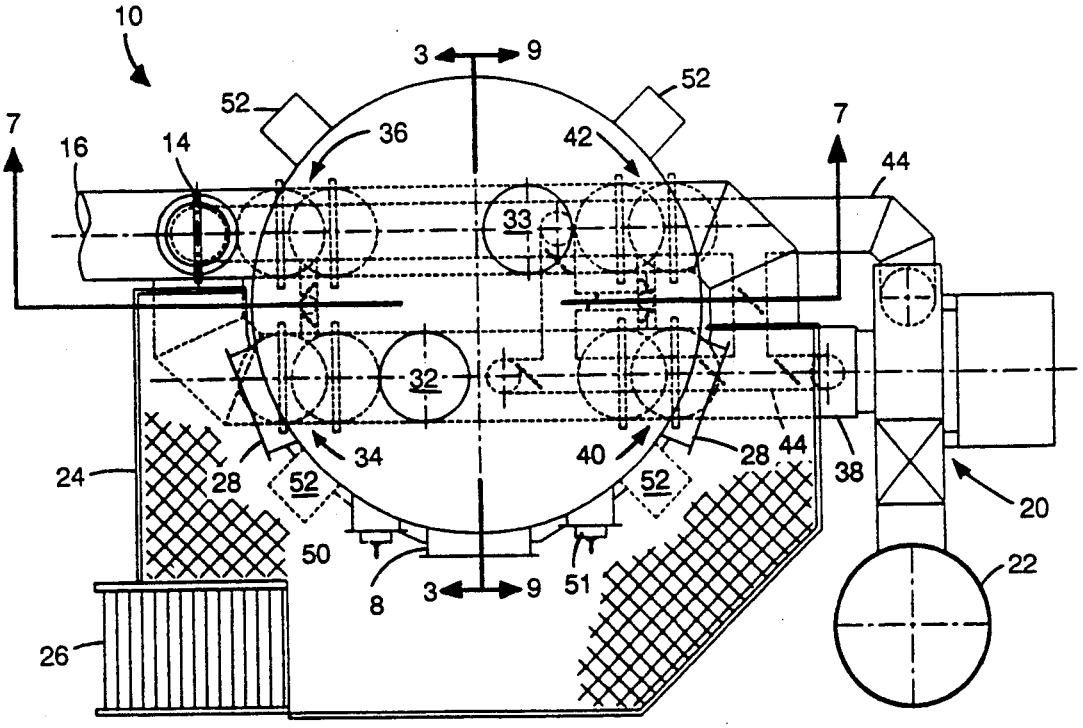
FIG. 2 is a plan view of the incinerator of FIG. showing portions of the ductwork in phantom.
Figure 3:
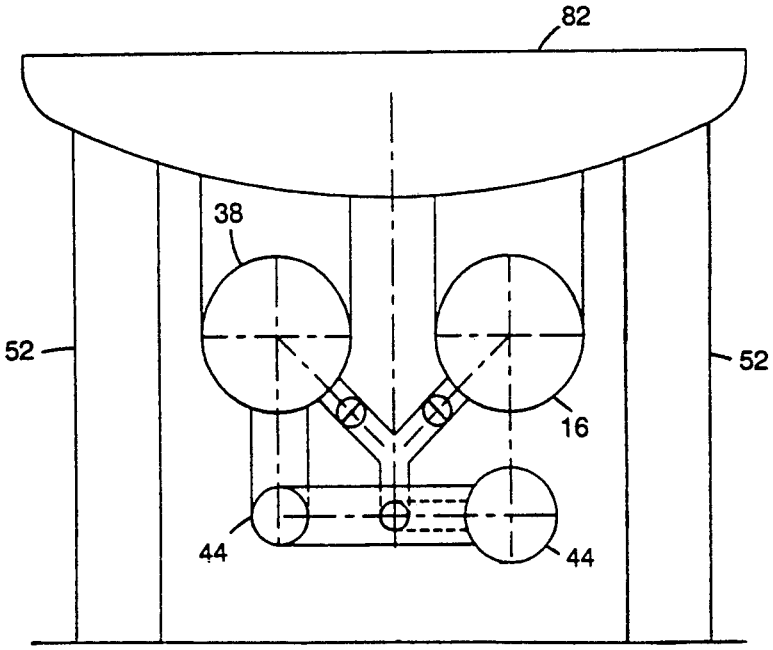
FIG. 3 is a partial section of the incinerator of FIG. 1 as indicated by 3—3 in FIG. 2.

Referring to FIGS. 1-3, the compact regenerative incinerator of the invention 10 includes a cylindrically shaped insulated vessel 12, which is positioned vertically, and a cluster 14, which includes ductwork and valving and is located generally below and adjacent to the vessel, for controlling the direction of passage of the effluent 18 through the incinerator. A typical vessel may have an overall height of about 27 feet and an outer diameter of about 15 feet. A ladder 26, platform 24, and rungs 30 allow access to hatches 28, which allow for inspection and loading of the thermal storage media.

An incinerator inlet duct 16 is connected to receive the effluent 18, which may include volatile organic compounds, from a process. Among the many compounds which may be incinerated are, for example, petroleum distillate, toluene, xylene, heptane, and methyl-ethyl ketone (MEK). The inlet duct 16 is connected to two bottom vessel openings 32, 33 via first and second duplex inlet valves 34, 36. An exhaust duct 38 is connected to the two openings in the bottom of the vessel by first and second duplex exhaust valves 40, 42. An exhaust fan 20 is connected to the exhaust duct to expel treated effluent into an exhaust stack 22 for release into the atmosphere The output of the exhaust fan is also connected to an exhaust recirculation duct 44, which is connected to the inlet duct and further ducts (see FIG. 4), to provide a pressurized flow of treated gas for recirculation, sealing of closed valves and flushing of the thermal storage media prior to changes in flow direction. A bypass duct 46 is connected to the inlet duct via a bypass valve 74 and leads to a third opening 48 in the vessel wall. Two burners 50, 51 are also mounted in the vessel wall, and the vessel is mounted on stilts 52.

Figure 4:
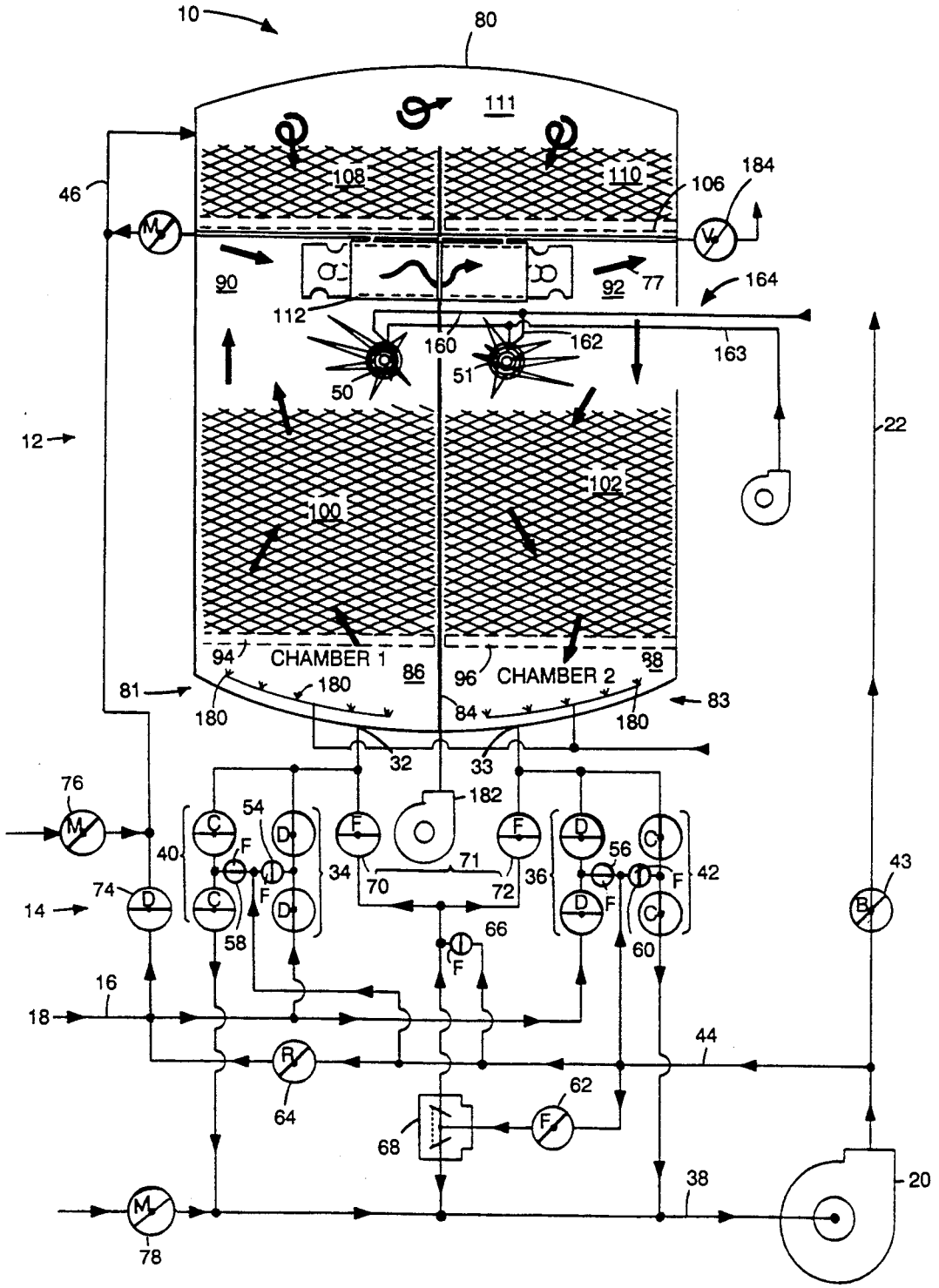
FIG. 4 is a system flow schematic of the incinerator of FIG. 1, showing flow in one direction through the incinerator.

Referring to FIG. 4, which schematically shows valves positioned for effluent flow into and upward through a first chamber of the incinerator and downward through and out of a second chamber, the exhaust recirculation duct 44 is also connected to a flush control valve 62, to a recirculation damper 64, and to slave flush valves 54, 56, 58, 60, 66 of inlet, exhaust, and first and second chamber flush valves 34, 36, 40, 42, 70, 72. The flush control valve 62 is connected to a three-way valve 68 (or "tee" damper), which is in turn connected to the exhaust duct 38 and the first and second chamber flush valves 70, 72. First and second chamber flush ducts lead to the two bottom vessel openings 32, 33. Make-up valves 76, 78 are also provided to admit air into the bypass duct 46 and the exhaust duct 38.

Figure 12:
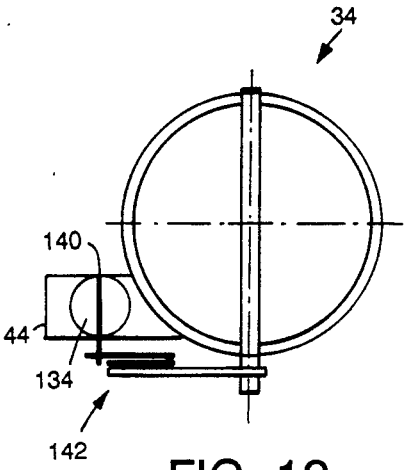
FIG. 12 is a diagrammatic end view of the flushed duplex valve of FIG. 10, as indicated by 12—12 in FIG. 11, including the valve linkage.
Figure 10:
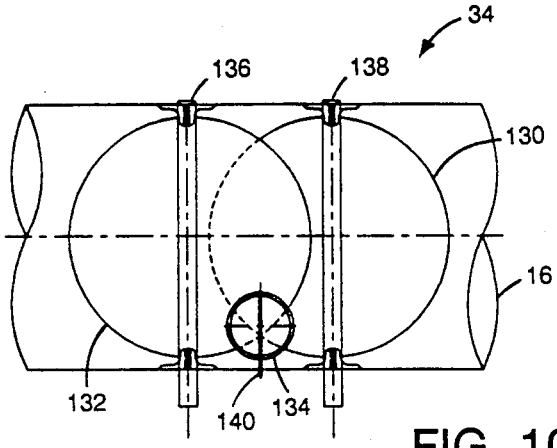
FIG. 10 is a diagrammatic elevation of a flushed duplex valve of the incinerator of FIG. 1.
Figure 11:
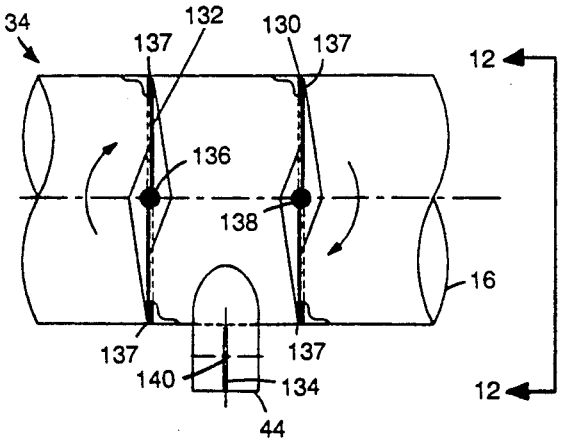
FIG. 11 is a diagrammatic plan view of the flushed duplex valve of FIG. 10.

Referring to FIGS. 10-12, a flushed duplex valve, for example the first flushed duplex inlet valve 34, includes a pair of main blades 130, 132 mounted on main shafts 138, 136, and a slave flushing valve blade 134 mounted on a slave shaft 140. The main shafts are linked to the slave shaft by a linkage 142 (see FIG. 12), which opens the slave flush valve after the main valves are closed.

Referring to FIGS. 1, 4, and 7-9, the vessel 12 is generally cylindrical in shape, with a rounded top 80 and bottom 82. A vertical dwarf partition 84 bisects the vessel from its bottom to an elevation some distance below the top of the vessel, splitting the vessel into two chambers of equal size 81, 83. This partition 84 is welded to the lower end of the vessel to provided an air-tight seal between the chambers. Primary grid-work 94, 96, forming a lower horizontal grating, is attached to the lower portion of the vessel, a short distance above its bottom, and to the partition 84 by brackets 98. The primary grid-work is made of a heat resistant steel such as a type 304 stainless steel, and supports first and second primary thermal storage media 100, 102, which may comprise a porous mass about eight feet deep of metal, ceramic, or any other material that is stable at the incineration temperature. Preferred thermal storage media are Flexisaddle chemical stoneware available from Koch Engineering of Akron, Ohio, with two-inch size utilized on the bottom twelve inches and one-inch size utilized for the remainder of the beds of media 100, 102. Secondary grid-work 104, 106 is similarly horizontally mounted in the vessel and is positioned near the top end of the partition to support a collective secondary thermal storage medium made up of first and second secondary thermal storage media 108, 110, which are about two feet deep. The secondary media may be of the same type as employed for the primary media, with the bottom six inches of the secondary beds formed of the two-inch size. Of course, other primary and secondary bed depths could be used, depending on the requirements of the particular system. The space between the top of the primary thermal storage media and the upper grating (secondary grid-work 104, 106) forms the combustion zone of the incinerator 10, which is separated into first and second combustion chambers 90, 92. The spaces below the first and second primary storage media, respectively, form first and second thermal recovery chambers 86, 88.

The vertical partition 84 (FIGS. 7-8) includes two metal sheets 119, which may be made of type 304 stainless steel, with spacers 120 (FIG. 8) between to maintain a gap of approximately 2 inches and to provide adequate stiffness without corrugation, thus presenting a minimum surface area. These sheets 119 incorporate expansion joints 122 at each end and their outer surfaces are insulated with ½ inch of ceramic insulation, such as Fiberfrax ®, 118 which is rated for continuous service to 2300° F. A cooling fan 182 (FIG. 4) feeds a manifold mounted across the bottom of the vessel and aligned with the partition 84, which serves as a distribution system for cooling air. The cooling air enters at the bottom of the partition and flows vertically at a velocity of approximately 1000 feet per minute (FPM) until the flow is split (FIG. 9) to go around a swirl tube 112, at which point the velocity increases.

The swirl tube 112 is mounted through a hole in the partition, somewhat below the secondary grates 104, 106. The swirl tube 112 is similar to the vertical partition in that it also is of a double walled construction with cooling air circulated between its walls. The hot side surfaces (inner and outer) of the swirl tube 112 are insulated with the Fiberfrax ® blanket and a spiral baffle 116 is mounted between the walls to maintain separation and provide high cooling air velocity. Cooling air enters at the intersection of the swirl tube 112 and the vertical partition and flows horizontally toward the ends of the swirl tube. At the ends of the swirl tube, the cooling air passes through a series of holes in its outer wall and into a collection annulus from which the air is directed to the secondary thermal storage media support grid framework.

Figure 7:
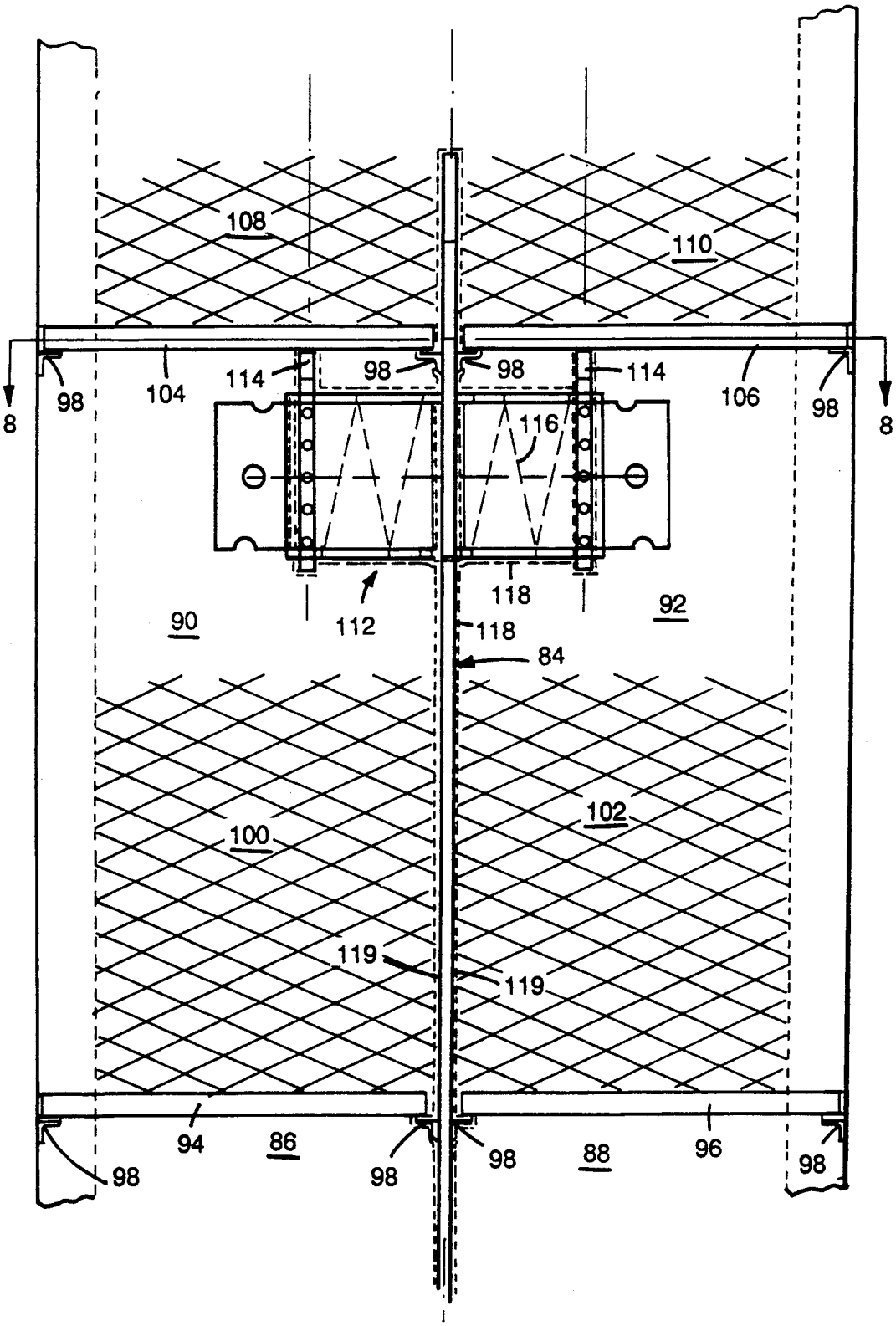
FIG. 7 is a partial cross section of the central portion of the incinerator of FIG. 1, as indicated by 7—7 in FIG. 2.
Figure 8:
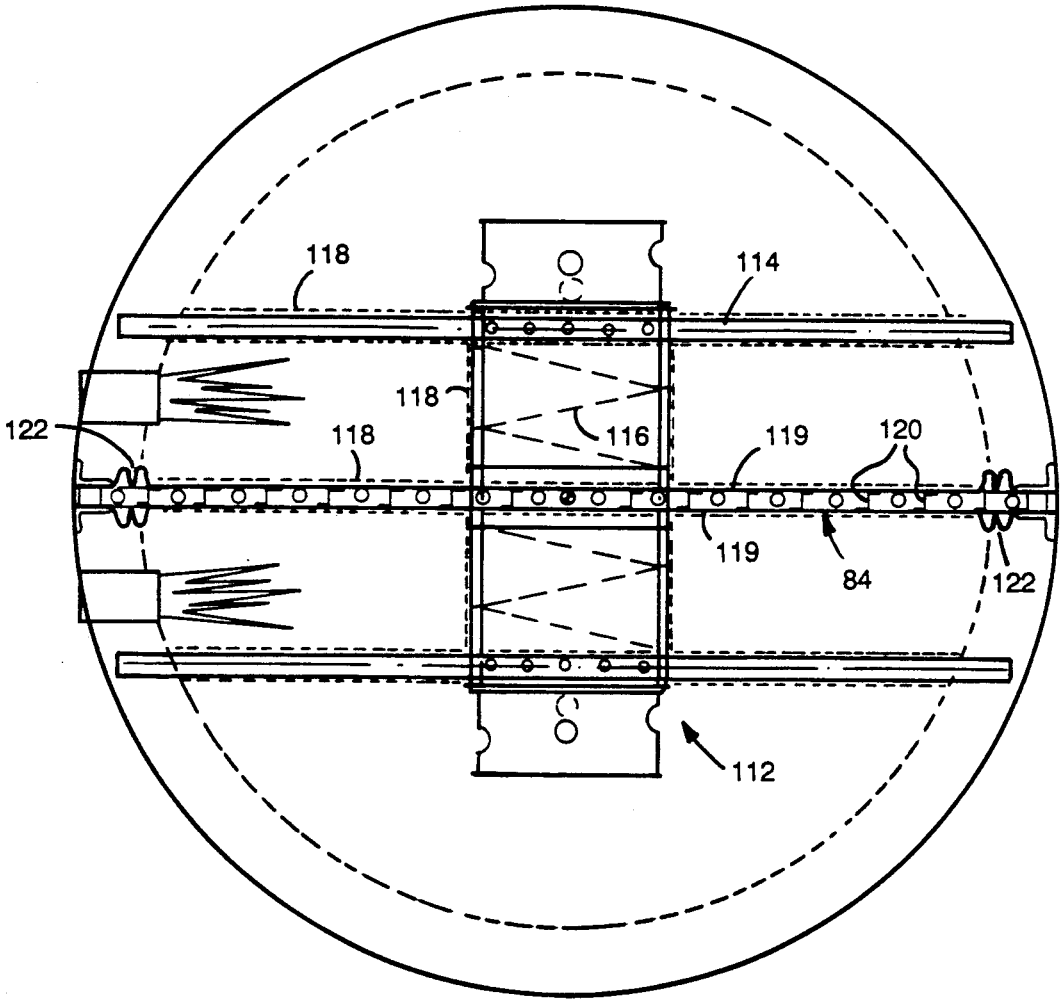
FIG. 8 is a partial cross section of the incinerator of FIG. 1 as indicated by 8—8 in FIG. 7
Figure 9:
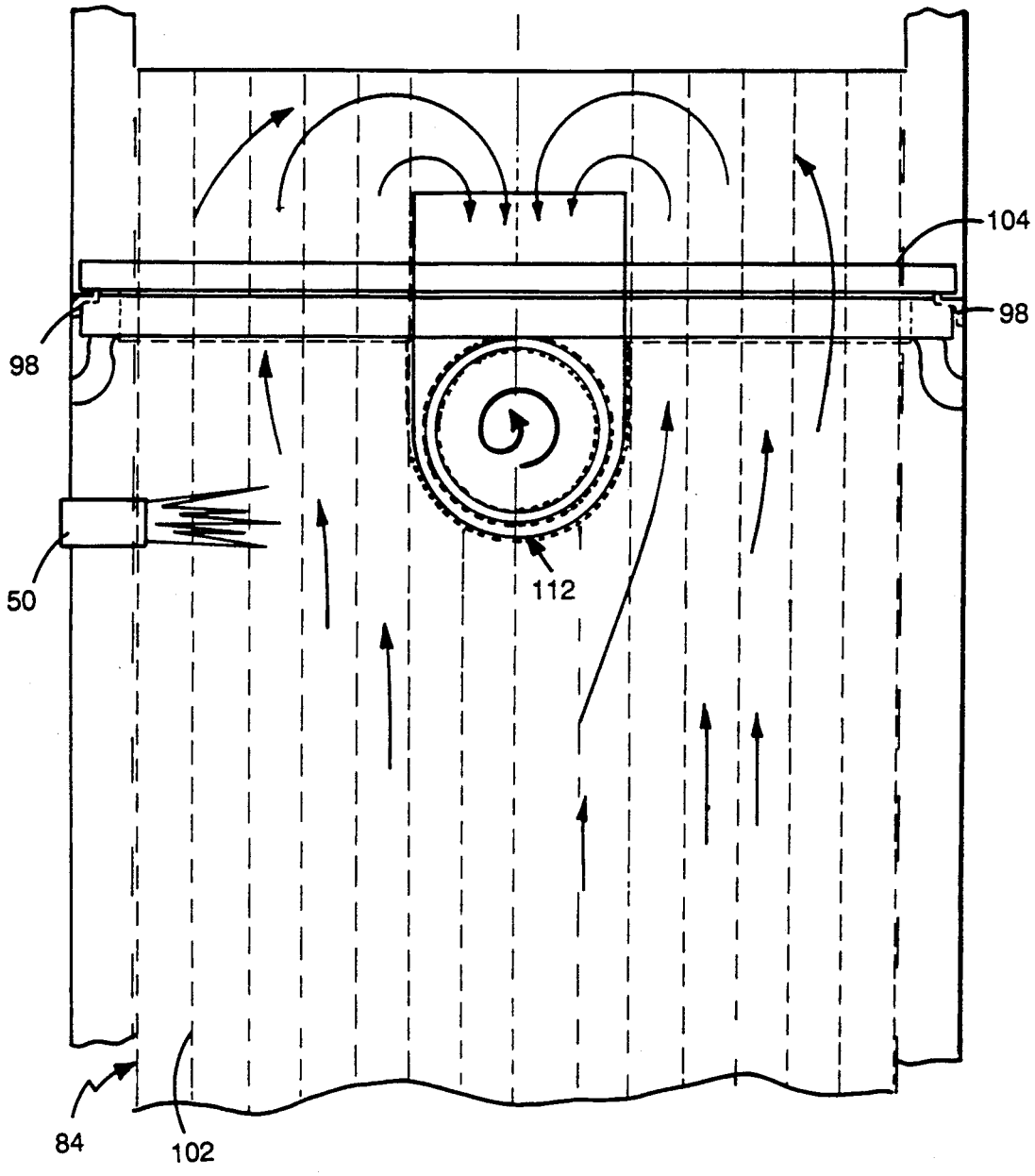
FIG. 9 is a partial cross section of the incinerator of FIG. 1 as indicated by 9—9 in FIG. 2, with arrows indicating the direction of cooling flow within the partition.

As is shown in FIG. 7, support for the upper media grid-work 104, 106 is provided by brackets 98 attached to the Vertical partition 84 across the center of the vessel, brackets 98 attached to the sidewall of the vessel and beams 114 which minimize the unsupported span. The beams 114 are rectangular tubes, which like the partition 84 and swirl tube 112, are insulated with a Fiberfrax ® blanket and have cooling air directed through them. The cooling air for these beams is the spent air from the swirl tube, which enters the beam tubes from the collection annulus and travels to the outer wall where the beams are supported. The air moves through the beam tubes at high velocity, and is exhausted by way of flexible tubes which penetrate the shell of the vessel 12. This air can be either vented to atmosphere through a vent valve 184, or collected via a cooling make-up valve 186 for use as make-up air in the process.

As stated above, a preferred insulation for protection of metal structures in the high temperature section is Fiberfrax ® Durablanket ® ceramic fiber insulation. (Fiberfrax ® and Durablanket ® are U.S. registered trademarks of the Carborundum Company, of Niagara Falls N.Y.). A suitable specific grade selected for use is the HP-S which is high strength and has low shrinkage. This material has a continuous use limit of 2300° F. and a melting point of 3200° F.

The secondary media support grid-work 104, 106 is similar to that used for the primary heat exchange media except that it is made of a high creep strength alloy, such as type 309 stainless steel, as it is subjected to higher temperatures. The loading for the secondary grid-work is relatively low and with the air cooled support structure below the grid-work providing a maximum free span of approximately ¼ of the vessel diameter, the grid-work will support the media even at higher excursion temperatures. To protect the grid-work from direct flame or high infrared radiation, a 0.010" coating of Fiberfrax ® refractory material is applied by spray painting or dipping. This coating has the same continuous use temperature limits as the insulation used on the vertical partition, swirl tube and grid support beams.

Figure 13:
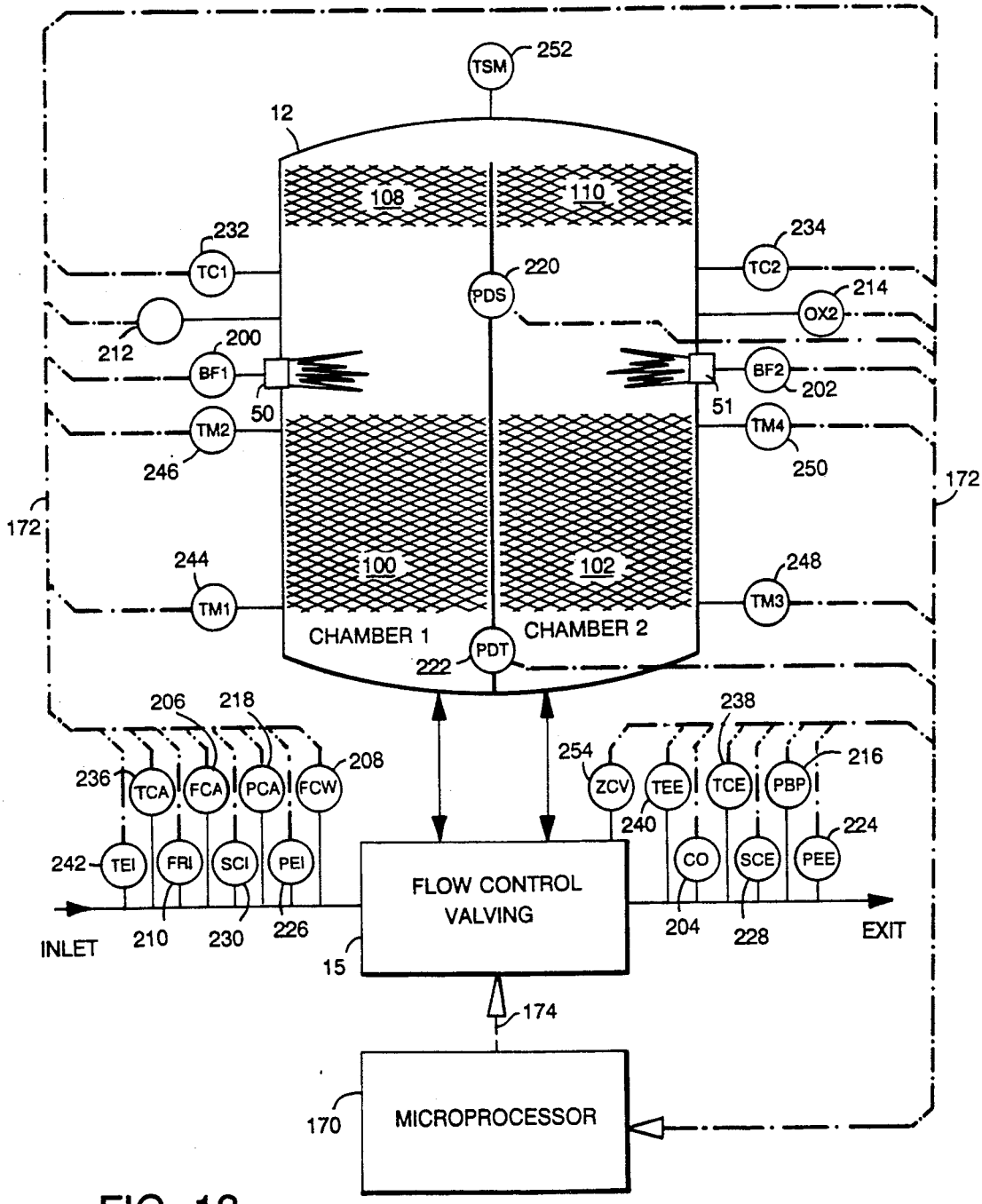
FIG. 13 is a schematic diagram showing the control elements of the incinerator of FIG. 1.

Referring to FIG. 13, the vessel 12 and its associated flow control valving 15, are monitored by sensors 200–254 associated with the functional components of the vessel as shown. The variables sensed by these sensors are presented in table 1. The sensors are connected to a microprocessor-based controller 170 by return lines 172, which may be a field buss, and the controller, in turn, is connected to the flow control valving 15 by control lines 174, which may also be served by the same buss. A multiple channel recorder is used to record temperatures and other system variables and to maintain operational records for the appropriate regulatory agencies as well as for use in trouble-shooting the system.

TABLE 1

| DESIG-NATOR | SYM-BOL | VARIABLE SENSED |
|---|---|---|
| 200 | BF1 | BURNER FIRING RATE #1 |
| 202 | BF1 | BURNER FIRING RATE #2 |
| 204 | CO | CARBON MONOXIDE MONITOR |
| 206 | FCA | COOLING AIR FLOW RATE |
| 208 | FCW | COOLING WATER FLOW RATE |
| 210 | FRI | FLOW RATE OF EFFLUENT AT INLET |
| 212 | OX1 | OXYGEN #1 MONITOR |
| 214 | OX2 | OXYGEN #2 MONITOR |
| 216 | PBP | BACK-PRESSURE FLUSHING LOOP |
| 218 | PCA | COOLING AIR PRESSURE |
| 220 | PDS | SWIRL TUBE PRESSURE DIFFERENTIAL |
| 222 | PDT | TOTAL INCINERATOR PRESSURE DIFFERENTIAL |
| 224 | PEE | EXHAUST PRESSURE AT EXIT |
| 226 | PEI | EXHAUST PRESSURE AT INLET |
| 228 | SCE | SOLVENT CONCENTRATION AT EXIT |
| 230 | SCI | SOLVENT CONCENTRATION AT INLET |
| 232 | TC1 | TEMPERATURE COMBUSTION CHAMBER #1 |
| 234 | TC2 | TEMPERATURE COMBUSTION CHAMBER #2 |
| 236 | TCA | TEMPERATURE COOLING AIR AT INLET |
| 238 | TCE | TEMPERATURE COOLING AIR AT EXIT |
| 240 | TEE | TEMPERATURE EFFLUENT AT EXIT |
| 242 | TEI | TEMPERATURE EFFLUENT AT INLET |
| 244 | TM1 | TEMPERATURE OF MEDIA #1 NEAR BOTTOM |
| 246 | TM2 | TEMPERATURE OF MEDIA #1 NEAR TOP |
| 248 | TM3 | TEMPERATURE OF MEDIA #2 NEAR BOTTOM |
| 250 | TM4 | TEMPERATURE OF MEDIA #2 NEAR TOP |
| 252 | TSM | TEMPERATURE IN AREA ABOVE SECONDARY MEDIA |
| 254 | ZCV | VALVE POSITION INDICATOR (ALL CONTROL VALVES) |

In operation of the compact regenerative incinerator of the invention (see FIGS. 4, 13), a stream of effluent consisting typically of air and some quantity of volatile organic compound which cannot be directly released to atmosphere is drawn at a suitable flow rate (such as 120000 SCFM) from the inlet duct 16 via the first inlet valve 34 into the lower end of the first thermal energy recovery chamber 86, and passes vertically upward through the first primary thermal storage medium 100. During this passage, the temperature of the effluent is raised by means of convective heat transfer of thermal energy from the thermal storage media 100, with a reduction in the temperature of the these media. Upon exiting from the thermal storage media 100, the effluent is heated additionally to the desired incineration temperature by means of a first burner 50 firing into the first combustion chamber 90. At this point the majority of the effluent enters the swirl tube 112, which passes through the vertical partition 84 between the chambers 81 and 83. The partition and swirl tube assure that the effluent being treated uniformly reaches the proper incineration temperature and is held for the required time duration before entry into the second primary thermal storage medium 102 where the stream temperature is subsequently reduced. As the effluent enters the swirl tube, its velocity increases resulting in the stream becoming very turbulent which in turn aids in the complete incineration of the volatile organic compounds in the effluent. To assure that effective turbulence is maintained, the system flow may be limited to no less than thirty-three percent of the design flow rate. The swirl tube pressure differential is therefore continuously monitored by the swirl tube pressure differential sensor 220 (FIG. 13), and the resulting data is analyzed by the controller 170, which may direct the recirculation damper 64 to open and admit a sufficient quantity of recirculation air to maintain the minimum flow.

A small portion of the heated effluent will bypass the swirl tube and cross the partition by flowing up through the first secondary thermal storage medium 108 positioned above the combustion chamber 90 and into the secondary combustion chamber 111 where it will remain for an additional period before flowing into the second combustion chamber 92 via the second secondary thermal storage medium 10. From the second primary combustion chamber 92, the treated effluent passes vertically downward through the second primary thermal storage medium 102, where heat energy is removed from the stream and stored in the medium for subsequent use by the incineration process to reduce the fuel usage. Upon exiting the second thermal energy recovery chamber 88, through the opening 33, the treated effluent passes through the second exhaust valve 42 and is exhausted to atmosphere via the exhaust duct 38, fan 20, and stack 22. The system exhaust fan 20 is located in such a position as to maintain a pressure within the system which is lower than atmospheric, thus preventing accidental release of untreated effluent.

The flow through the thermal storage media results in a continuously changing level of energy potential (average temperature) with one thermal storage chamber cooling down as the other is increasing in temperature. At some point in time the flow direction must be reversed to recover the stored thermal energy. In the conventional regenerative system, this reversal occurs on a fixed time cycle basis which in turn places a restriction on the range of solvent loadings usable for a specific design. In the compact regenerative incinerator system of the invention, the length of time between flow reversal cycles is variable, which allows for adjustment of the heat recovery effectiveness corresponding to the solvent loading of the effluent to be treated and consequently optimization for these varying conditions. A typical time between reversals may be one and one-half to two minutes; however, the exact moment in time at which the reversal sequence is initiated is determined by real time analysis in the controller 170 of system variables such as air flow rate, solvent concentration of effluent, temperatures, burner firing rate, damper positions, and carbon monoxide and oxygen levels.

These system variables have different effects on the controller's determination of optimum time between reversals. The air volume flow rate, as measured by the inlet flow rate sensor 210, has the most dramatic effect on the time rate of change of the energy level in the thermal storage media 100, 102, and therefore has the largest effect on optimum reversal timing. A higher flow rate will reduce the time required to raise the first or lower the second primary thermal storage media average temperatures. In a fixed schedule incinerator, this increased flow rate would reduce the temperature differences from the entries to the exits of the media 100, 102 to inefficient levels before the end of a cycle. In high flow rate conditions, therefore, the controller 170 will operate the flow control valving 15 to shorten the cycle, thereby providing for efficient thermal exchange.

The solvent concentration by volume in the effluent, as monitored by the inlet solvent concentration sensor 230, is also important, since it is proportionally related to the exothermic temperature rise of the effluent being treated. In an ideal situation, the temperature of the effluent at the exit of the preheat media bed, plus the exothermic temperature rise, would equal the control temperature required for the desired hydrocarbon destruction effect. When the solvent concentration rises, however, the oxidation process releases a larger amount of energy and quickly heats all exposed components, including the partition 84, swirl tube 112, beams 114, upper media grid-work 104, 106 and the upper media 108, 110. If this process were allowed to continue for too long, a dangerous over-temperature condition would occur. As solvent concentrations rise, therefore, the controller 170 will operate the flow control valving 15 to shorten the cycle, in order to protect or to limit the temperature to which the components would be exposed.

The constraints of the system define a minimum cycle time value, however, below which the controller 170 will not shorten the cycle. Once this point is reached, recirculation air is added by opening the recirculation valve 64 to increase the mass flow and reduce the solvent concentration and hence the temperature rise. Should this be insufficient, fresh make-up air at ambient temperature is introduced directly into the vessel 12 in place of the blend of recirculated air, through make-up valve 76.

There are also concentration levels below which the energy provided by the effluent oxidation is insufficient to raise the temperature high enough to completely destroy the volatile organic compounds (VOC). At these levels, the burners must be fired in order to maintain the effluent in the combustion chambers at the required temperature for a sufficient duration. Multiple combustion chamber temperature sensors, such as thermocouples, 232, 234 are placed within each combustion chamber, and these are averaged to control the parallel burners 50, 51. Media temperature sensors 244, 246, 248, 250 are placed at the entry and exit of each of the thermal energy storage media beds to measure the dynamic rate of change of stored energy. This information, along with the effluent inlet and outlet temperatures, as measured by the inlet effluent sensor 242 and the exit effluent sensor 240, is used in calculating the system heat exchanger effectiveness on a real time basis, and in determining (based on rate of change) when the flow direction change is to be made.

The amount of thermal energy (natural gas) input into the system by the burners is also continuously monitored by burner firing rate sensors 200, 202 and is tracked on a real time basis by the controller 170. During any given operating cycle, the preheat temperature of the effluent going into the combustion chamber is continuously decreasing because the energy level of the thermal storage media is diminishing, so the burners are adjusted to provide the extra thermal energy required to incinerate the effluent. To minimize fuel usage, therefore, the cycle time between flow reversals is adjusted to minimize the average firing rate when the effluent concentration is low enough to require burner firing.

The regenerative incinerator of the invention may thus accommodate concurrently changing flow rates and solvent concentrations. The controller 170 calculates the appropriate cycle length, burner firing level and, if necessary, allows for recirculation or make up air. These operations can be performed with the controller programmed to optimize heat recovery effectiveness, based on a computer model for the parameters of the particular system. At a high volume flow rate with a low solvent loading the energy recovery is thereby maximized for optimum fuel usage. Conversely, at low volume flows and high solvent loadings, a reduced heat recovery level is provided to prevent a destructive over-temperature situation.

The incinerator of the invention provides a significant advantage over a fixed time system. This is in part because at any specific effluent flow rate and time between flow reversal cycles, the average heat exchanger effectiveness of the thermal storage media system is a fixed value. This means that for a fixed time system the maximum effectiveness must match the projected maximum solvent loading to prevent an over-temperature situation. A fixed time system would therefore suffer from ineffectiveness during that portion of its operation where the process did not operate at maximum loading. The incinerator of the invention, on the other hand, can adjust the cycle time and/or the mass flow (while possibly adding recirculation air or fresh make-up air) to match the exothermic energy release without exceeding safe operating temperature limits at high solvent concentrations, or using excessive natural gas at low solvent concentrations.

Carbon monoxide is monitored by the carbon monoxide sensor 204 as it is generally considered a good measure of the clean-up efficiency of an incinerator, and monitoring of the output CO is required in many geographical locations. Should the CO level exceed a predetermined maximum level, the control system will increase the minimum average temperature or adjust the timing cycle to reduce the average output CO concentration.

The percentage of oxygen in the effluent stream must be maintained above some minimum value to assure complete combustion of the hydrocarbons. The oxygen level is therefore monitored by the oxygen level sensors 212, 214 and should its value go below a preset standard, the fresh make-up air damper 76 is opened to allow fresh air into the system. If a low oxygen situation occurs, it would tend to occur while some degree of recirculation is being employed. In this situation, make-up air is introduced and the recirculation is reduced to maintain a balanced system flow. The timing cycle is also adjusted, to compensate for introduction of the cooler fresh air.

The solvent level at the exit of the incinerator may also be directly measured, by an exit solvent concentration sensor 228. This provides the controller and operators with a direct measurement of the operating clean-up efficiency of the incinerator.

To enable the control algorithm to make logical decisions concerning the operation of the system, the position of all control dampers or valves is also monitored 5 by the valve position indicators 254. For those dampers which are modulated somewhere between open and shut, the specific position is reported. Knowing the status and applying the rationale of a decision tree, the control algorithm can select the most effective or efficient course of action.

In addition to establishing the flow reversal, the microprocessor-based controller 170 functions as a safety system which modulates the bypass valve 74, recirculation valve 64 and make-up air damper valves 76, 78 on a priority basis to protect the critical components from excessive temperature. The temperature in the area above the secondary media is monitored as well, to assure that effluent passing through the bypass system will be adequately preheated. The full control system also contains the normal complement of safety related devices such as a flam safeguard and high temperature limit switches.

The cooling air sensors 206, 218 monitor proper operation of the cooling air for the air cooled portions of the system, and the cooling water sensor 208 similarly monitors the cooling water, which will be described in more detail below. The pressure at the inlet is measured with an inlet exhaust pressure sensor 226, and the controller 170 maintains this pressure at a predetermined value, generally below atmospheric pressure, so as to assure that adequate draw is provided from the process, which may include multiple sources of effluent. The pressure at the outlet is measured by an exit exhaust pressure sensor 224 placed after the exhaust back-pressure valve 43, in order to detect possible blockages or other exhaust flow restrictions. A total incinerator pressure differential sensor 222 provides a secondary, or backup, indication of flow through the system.

Figure 5:
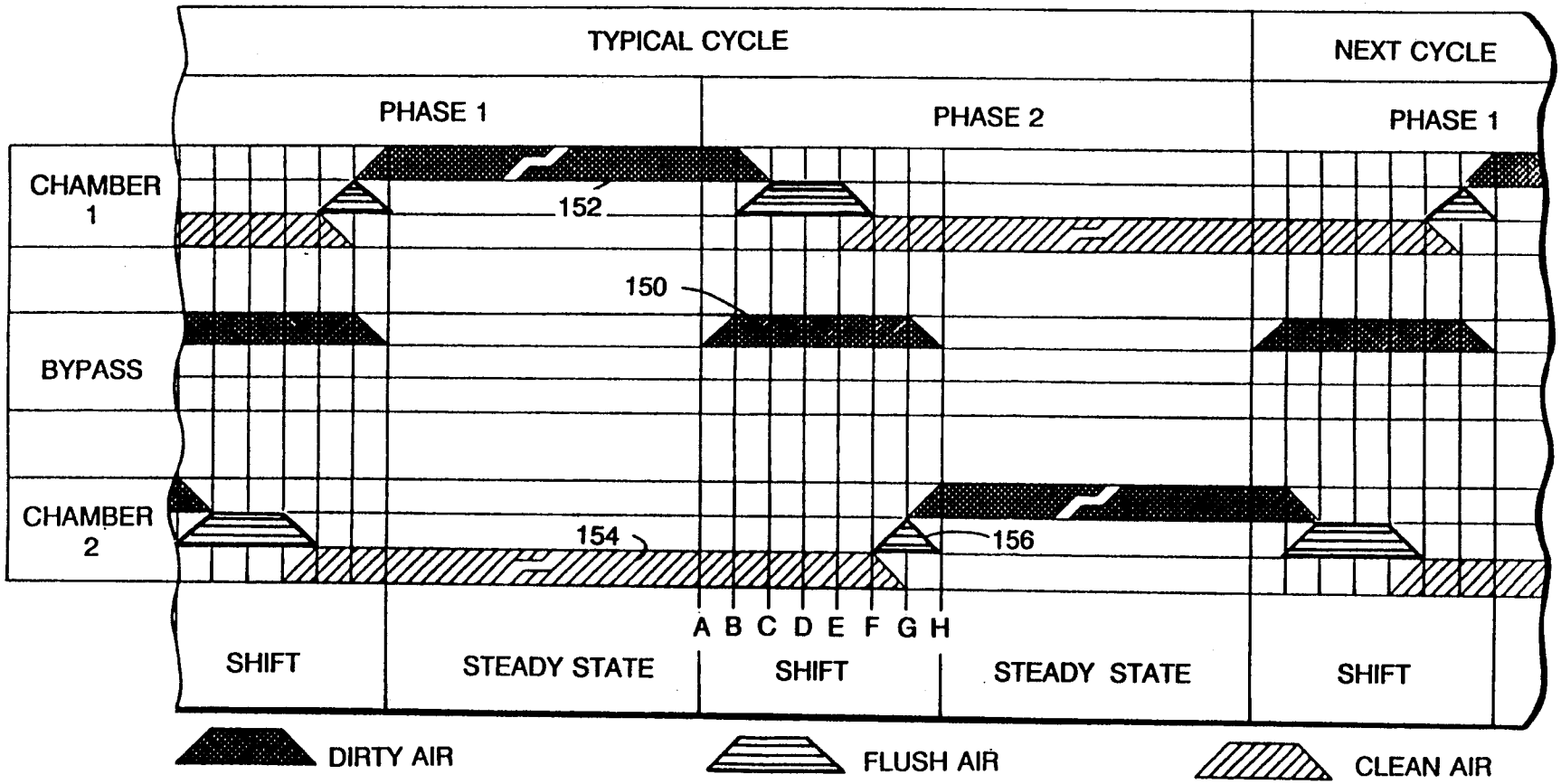
FIG. 5 is a flow sequencing chart for the incinerator of FIG. 1, for a typical cycle.

Referring to FIGS. 4 and 5 (note timing letters in FIG. 5), the process for flow reversal (labelled "SHIFT" in FIG. 5) is accomplished by use of a precisely timed sequence of control valve position changes, which assure uninterrupted flow from the process while preventing the escape of untreated effluent to the atmosphere. In describing the actual sequence, which may extend over a time interval of about fifteen seconds, it is assumed that at the start of the cycle the untreated effluent is entering the first recovery chamber 86, and the treated gasses are exiting from the second recovery chamber 88. This state corresponds to the valve positions and flow arrows in FIG. 4, and to the steady state portion of phase 1 of the first cycle in FIG. 5.

At initiation of the changeover (A in FIG. 5), the bypass valve 74 opens (A-B) to route the untreated effluent (150) through the bypass duct 46 to the secondary combustion chamber area 111 at the top of the incinerator vessel where it is heated by passage through the secondary thermal storage medium, 108, 110, exiting into the primary combustion chambers 90, 92. The bypass system is provided to maintain continuous uninterrupted flow of the untreated effluent into the incinerator without release of untreated effluent into the environment during reversal of flow direction through the primary thermal storage media. During bypass, the untreated effluent is brought from the bypass duct 46, through the secondary combustion chamber 111, to the main combustion chamber area 90, 92.

During that period in time when the untreated effluent is being brought into the vessel 12 by way of the bypass system, it is of a significantly lower temperature because it has not passed through the primary thermal storage media. To prevent cooling of the high temperature effluent in the combustion chamber and the subsequent reduction in clean-up efficiency, the effluent brought in by way of the bypass duct 46 is made to pass through a secondary mass of thermal storage medium 108, 110 where its temperature is elevated before entering the combustion chamber. The quantity of thermal storage medium used in the bypass load leveling configuration is no greater than that required to assure the effluent temperature is maintained above some designated value until completion of the changeover cycle. It is noted that the energy level of the secondary thermal storage media 108, 110 is restored by normal convective heat transfer and by radiation from the combustion chambers 90, 92 and various surfaces within the vessel 12, during normal operation. Once preheated, the effluent from the bypass duct 46 passes into the main combustion chamber area 90, 92, and mixes with that which is simultaneously being driven from the primary thermal storage media and is in turn heated to the required temperature for destruction prior to being exhausted.

With bypass established (B of FIG. 5), the flow of untreated effluent (152) into the recovery chamber 86 is stopped by closing the first inlet valve 34, and the first flush valve 70 is opened to permit previously treated recirculation air to enter the chamber 86 through opening 32 and flow for such a time duration (B–F) as to assure that no untreated effluent remains within the first primary thermal storage medium 104. During the flushing period, which may extend over a period of about ten seconds, flow of treated effluent (154) continues uninterrupted from the second recovery chamber and the untreated gasses (150) remain directed into the vessel through the bypass duct 46. Once the flushing is completed, the first flush valve 70 closes (E–F), the exhaust valve 40 for the first recovery chamber opens (E–F) with the subsequent closure (F–G) of the exhaust valve 42 for the second recovery chamber. To assure that there is no cross-contamination, as second exhaust valve 42 closes (F–G), its associated chamber flush valve 72 opens and remains open until that exhaust valve 42 is fully closed and the alternate valve is fully open (H, 156). Following this short flushing, the second inlet valve 36 opens (G–H) allowing flow of untreated effluent into the second chamber and the bypass valve 74 closes, completing the flow reversal cycle (H).

Inadvertent release of untreated effluent into the environment at any time the flow direction control valves change position is of prime concern. To minimize that potential, sequential valve movements are not executed until completion of the previous operation is proven by limit switch.

Referring to FIG. 4, it is noted that at the initiation of the thermal storage media flow direction changeover cycle, the system experiences a temporary increase in flow volume rate due to the additional air brought into the system to dilute the untreated effluent in the thermal storage media. Because acceleration of both the exhaust fan and the air volume are limited by inertia, the system flow rate is preferably allowed to accelerate to the anticipated value before the changeover cycle begins to prevent a momentary reduction in flow into the incinerator while the fan accelerates.

Upon receiving the signal that the changeover is imminent, the flush control valve 62 opens to a predetermined position at a rate which is less than the exhaust fan acceleration rate. During this period the flushing airstream is directed by the "Tee" damper position to the clean exhaust allowing the exhaust fan to accelerate. When the system volume has reached the desired flow rate and has stabilized, the flush damper is opened simultaneously with the shift in position of the three-way valve 68 and closure of the subservient flush valve 66. At completion of the changeover cycle, the dampers resume their original position to await the next cycle. It is noted that the flushing air stream need not come from the incinerator exhaust, but may come from another source.

The changeover cycle timing is predicated on the flushing operation being completed within a specific time period. To make this possible the flow rate for the flushing gasses must be held constant regardless of what the effluent flow rate is. This is accomplished by monitoring the back-pressure in the exhaust duct with a back-pressure flushing sensor 216, and maintaining it at a constant level with the exhaust pressure balance valve 43. As a result, the pressure in the flush duct is similarly held constant. With this arrangement the flush control damper setting can be established without concern for total system flow rate or the amount of air being consumed by the primary damper sealing system.

The temperature management system for the compact regenerative incinerator system of the invention includes mounting of separate burners, such as a Kinemax natural gas-fueled burner available from Maxon Corporation of Muncie, Indiana, in the walls of the vessel 12 so as to fire into each of the primary combustion chambers to provide the additional heat energy needed to achieve the desired minimum incineration temperature. Although these burner assemblies 0 and 51 are physically located to fire into separate chambers 90 and 92, they are preferably fired in parallel as if they were a single burner. To assure an equal firing rate from each burner, the natural gas and combustion air piping 160, 162, 163 to each burner 50, 51 is exactly the same length, being of the same size and having the same number of elbows. This allows for utilization of a single gas train 164 to supply both burners with the required fuel and air mixture. For safe operation, the flame of both burners is monitored simultaneously by a single, dual input, flame safeguard unit which will alarm if any abnormal condition appears at either burner. In one embodiment of the invention, the design operating temperature is 1500° F. and one can expect temperature excursions which could potentially reach 1800° F.

The temperature sensors 232, 234 in each of the primary combustion chambers 90, 92 monitor the temperature therein. Since dwell time at temperature is a key factor in the effective destruction of volatile organic compounds, the resulting signal is sent to the controller 170, which, in turn, calculates the real time temperature average and adjusts the burner firing rate accordingly. This arrangement is advantageous because it accurately maintains the desired average temperature, which is generally dictated by environmental quality regulations, while at the same time accounting for the heat energy released by the effluent being treated. This operating configuration will minimize the potential for excessive amplitude of the individual chamber burner firing rates, while firing the burners less frequently and with greater uniformity and ultimately reducing the natural gas consumption over time.

Use of the parallel burner system is considered an acceptable arrangement by most insurance underwriters and governmental agencies. In situations where local codes may require that each burner be equipped with its own gas train, flame safeguard and temperature control, the temperature sensor mounted in the chamber into which the burner is firing would provide a control signal through the controller. With this configuration, the desired reaction temperature is assured before effluent passes to the other chamber.

Referring to the valve structures of FIGS. 10–12, the control valve system for management of the operation of the incinerator must form a tight and complete seal to prevent flow of untreated effluent directly to the system exhaust. This is mandated by the fact that the valves must seal against the pressure drop across the entire incinerator system because both the duct 16 transporting the untreated effluent to the incinerator and the duct 38 carrying the treated effluent to the exhaust fan 20 are connected at a common point where they enter the base of the vessel 12. To assure that there is no leakage, the five valve systems 34, 36, 40, 42, 71, which control the flow direction into and out of the energy recovery chambers employ a flushed duplex design.

When the main blades 130, 132 of these valves are closed, the linkage 142 opens the slave flushing valve blade 134 to tangentially introduce pressurized flushing air, of a pressure higher than that exerted on the main blades, into the space between the main valve blades when they are in the closed position. The linkage that performs this function is a spring-loaded progressive linkage, which first closes the first main blade, then the second, and once these are closed, opens the slave blade. In the closed position, each main valve blade 130, 132 will seat against a gasket surface 137 to minimize potential for leakage, and any leakage will cause flushing air to be leaked, as opposed to untreated effluent. No other control valves require the flushed duplex design since leakage at those locations cannot result in the release of untreated effluent. It is noted that the flush valve system 71 includes a subservient flush valve 66 as do the other duplex valves, but these valves 70, 72, 66 are controlled independently by the controller, rather than linked by a linkage.

The system exhaust fan 20 is limited by its construction to a temperature generally below the potential achievable within the vessel 12. The system exhaust temperature is continuously monitored and in the event that the temperature exceeds an established limit, a protection system uses a multiple level priority structure to evaluate and determine the course of action. Potential courses of action include but are not limited to those available for heat exchanger effectiveness control—e.g., direct addition of ambient air to the exhaust stream to reduce the temperature, or the use of evaporative cooling system, which consists of a number of water spray nozzles 180 mounted on a manifold which in turn is placed in the exhaust duct 38 before the fan inlet or in the area directly below the thermal storage media. Temperature of the exhaust air is reduced by absorption of the thermal energy in the process of phase change from liquid water to water vapor. With a latent heat of vaporization of approximately 1000 BTU per pound of water, the cooling potential is very high. It should be noted that if the spray nozzles are placed under the thermal storage media chambers, a separate manifold would be employed for each chamber. The evaporative cooling system is useful in protecting the valving and exhaust fan from over-temperature damage but should not be operated during the inlet cycle, since that has the potential of cooling the effluent at a rate which may exceed the burner recovery rate. This, in turn, could result in incomplete incineration of the effluent.

The evaporative cooling is an important safety feature, as it allows for cooling of the fan without stopping it, while providing time for orderly system shutdown. Stopping of the fan during operation of the incinerator could lead to an excessive or dangerous solvent concentration at the source of the effluent.

Figure 6A:
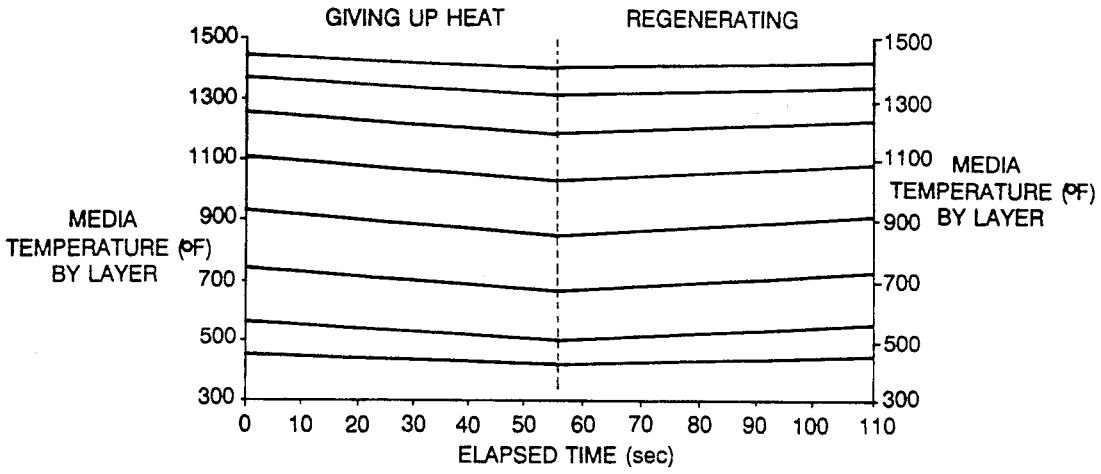
FIG. 6A is a plot of temperature against time at various depths of the first primary heat storage media of the incinerator of FIG. 1, in one foot steps from its top, for the typical cycle of FIG. 5.
Figure 6B:
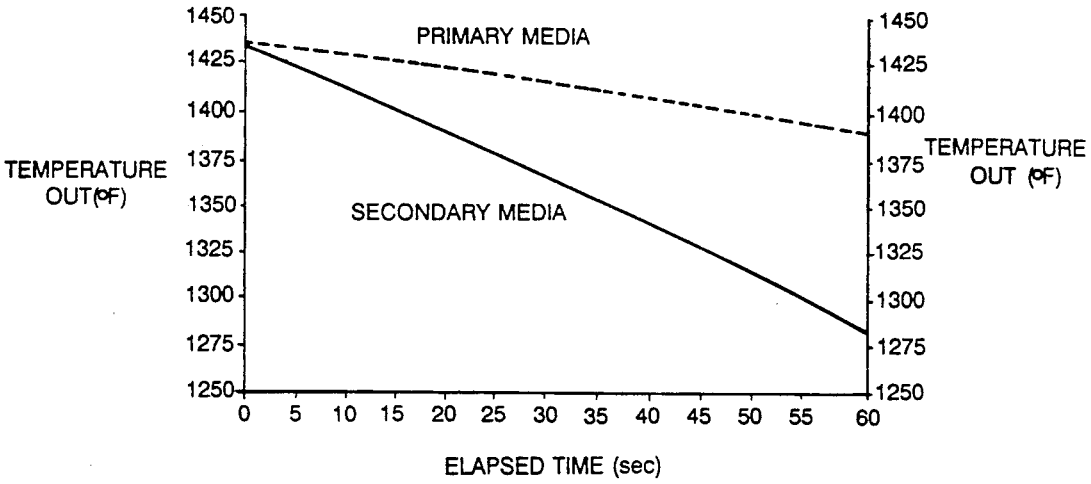
FIG. 6B is a plot of air temperature exiting the media against time, comparing the effect of the same level of flow through the primary and secondary heat storage media of the incinerator of FIG. 1.

FIG. 6A shows the temperature profile of the first primary thermal storage medium 100, for a typical cycle from the top to the bottom at one foot intervals. As would be expected, the temperature of the media layer closest to the combustion chamber is the highest. This overall temperature profile shifts downward in temperature by a few tens of degrees as the medium preheats the effluent (left portion of FIG. 6A, corresponding to phase I of FIG. 5) and increases by the same amount while heat is being recovered (right portion of FIG. 6A, corresponding to phase 2 of FIG. 5).

Referring to the media exit temperature profiles of B, the intent of the secondary thermal storage media 108, 110 is only to provide preheating during the short duration of the flushing cycle when untreated effluent is being brought into the vessel 112 through the bypass duct 46. Because this layer is of a much smaller mass than that of the primary thermal storage media 100, 102, the decay in air temperature exiting the media is considerably faster than for the full size bed and extended running in the bypass mode will impact the overall heat exchanger effectiveness. This is clear from the rather evident difference between the slope of the air temperature out curves for the primary flow (dotted line) and that of the secondary flow. Based on the sixty second time line for the primary media, the average heat exchanger effectiveness is 92.7%. The same average is matched over an eighteen second time span in the secondary media, which happens to coincide with the time for flushing and valve switching, with a couple of seconds to spare.

Other embodiments are within the following claims.

I claim:

1. A regenerative incinerator for incinerating an effluent, comprising:

a vessel, a partition separating said vessel into first and second compartments, each of said compartments including an opening, a combustion chamber, and a primary thermal storage medium between said combustion chamber and said opening, said partition further defining a passage between the combustion chambers of said first and second compartments, burner means for heating effluent in said combustion chambers, a bypass system including a bypass opening in said vessel and a bypass thermal storage medium separating said bypass opening from said combustion chambers, and valve means connected to said openings for directing the effluent to flow into the vessel through one of said first and second openings and directing the products of incineration of the effluent to flow out of the vessel through the other of said first and second openings, said valve means being adapted to reverse said flow direction between said first and second openings and to direct the effluent into the vessel through said bypass opening while reversing said flow direction.

2. The incinerator of claim 1 further comprising a swirl tube mounted in said passage, said swirl tube being adapted to direct effluent from one of said combustion chambers to the other of said combustion chambers.

3. The incinerator of claim 2 wherein said partition includes a pair of walls, said walls defining a space therebetween for circulating cooling air for cooling said walls, and said swirl tube has passages for circulating cooling air for cooling said swirl tube.

4. The incinerator of claim 1 wherein said vessel is generally cylindrical, with a rounded top and bottom, wherein said partition is generally vertical, wherein said primary thermal storage media are mounted proximate the bottom of said vessel, beneath said combustion chambers, and wherein said bypass thermal storage medium is mounted above said combustion chambers.

5. The incinerator of claim 1 wherein said incinerator is a single-vessel incinerator.

6. The incinerator of claim 1, wherein the effluent flow contains a material to be incinerated at delivery levels that vary over time, said incinerator further comprising controller means for monitoring the temperature of the effluent entering the vessel, the temperature of said products of incineration exiting the vessel, the rate of change of said temperatures and the concentration of the material to be incinerated in the effluent, and for using information resulting from said monitoring to control said valve means.

7. The incinerator of claim 1, further comprising an exhaust fan connected to said valve means for drawing the effluent into said vessel and expelling said products of incineration therefrom, a purging system connected to said valve means and including:

recirculation ductwork connected to receive a portion of said expelled products of incineration and direct them to purge said one of said primary thermal recovery media and its associated combustion chamber prior to reversal of said flow direction and an exhaust pressure balance damper for receiving said expelled products of incineration and regulating their pressure in said recirculation ductwork so as to purge said one of said primary thermal recovery media and its associated combustion chamber within a set period of time.

8. The incinerator of claim 1, further comprising an exhaust fan connected to said valve means for drawing the effluent into said vessel and for expelling said products of incineration therefrom, and a purging system connected to said valve means for purging with a flushing gas one of said thermal recovery media and its associated combustion chamber during said reversing, said purging system including a valve connected to a source of flushing gas and to said valve means for permitting flow of said flushing gas and said products of incineration to said exhaust fan so as to permit acceleration of said exhaust fan before flushing gas is furnished to said valve means and said chamber.

9. The incinerator of claim 1, wherein said valve means includes an incinerator control valve comprising:

a main duct, a flushing duct communicating with said main duct at a point of intersection, a pair of main blades mounted in said main duct, spaced along the length of said duct, each of said main blades being mounted on opposite sides of said point of intersection, a slave blade mounted in said flushing duct, and a linkage linking said main blades and said slave blade to open said slave blade when said main blades are closed.

10. The incinerator of claim 1, further comprising first and second essentially identical burners mounted for delivering combustion products into said combustion chambers of said first and second compartments respectively, a gas train, and first and second fuel pipes connected to said gas train and to said first and second burners, respectively, said first and second fuel pipes being essentially identical so as to provide essentially identical fuel flows to said burners and thereby cause said burners to burn at essentially identical energy input levels.

11. The incinerator of claim 10 further comprising a controller and a pair of thermocouples mounted to monitor the temperature of each of said combustion chambers, said controller adapted to calculate a real-time average temperature, and to use said real-time average temperature to control said burners.

12. The incinerator of claim 1, further comprising an exhaust duct connected to receive said products of incineration generated in said combustion chambers, an exhaust fan operable to draw said products of incineration from said exhaust duct, a liquid delivery conduit for delivering liquid to said exhaust duct, and a controller for monitoring the temperature of said exhaust fan and controlling said liquid delivery conduit to cool said exhaust fan by delivering liquid to said exhaust duct if said temperature exceeds a predetermined value, without requiring said exhaust fan to stop drawing said products of incineration.

13. A regenerative incinerator for incinerating an effluent flow containing a material to be incinerated at delivery levels that vary over time, comprising:

a vessel including first and second combustion chambers, first and second thermal recovery media respectively associated with said first and second combustion chamber, valve means for directing the effluent to flow through one of said first and second thermal recovery media into its associated combustion chamber, and directing said products of incineration of the effluent to flow out of the other of said combustion chambers and then through its associated thermal recovery medium, said valve means being adapted to reverse the direction of flow of said effluent, and sensing means for monitoring the temperature of the effluent entering the vessel, the temperature of said products of incineration exiting the vessel, and the concentration of the material to be incinerated in the effluent, and a controller for using information resulting from said monitoring to control said valve means to reverse said flow direction.

14. A regenerative incinerator for incinerating an effluent flow, comprising:

a vessel including first and second combustion chambers, first and second thermal recovery media respectively associated with said first and second combustion chambers, an exhaust fan connected to draw the effluent into said vessel and expel the products of incineration therefrom, valve means connected to said exhaust fan for directing the effluent to flow through one of said first and second thermal recovery media into its associated combustion chamber, and directing said products of incineration of the effluent to flow out of the other of said combustion chambers through its associated thermal recovery medium, said valve means being adapted to reverse said direction of flow of said effluent, and a purging system connected to said valve means and including recirculation ductwork adapted to receive a portion of said expelled products of incineration and direct them to purge said one of said thermal recovery media and its associated combustion chamber during said reversing, and an exhaust pressure balance damper adapted to receive said expelled products of incineration and to regulate their pressure in said recirculation ductwork so as to purge said one of said thermal recovery media and its associated combustion chamber within a set period of time..

15. A single-vessel regenerative incinerator for incinerating an effluent flow, wherein the effluent flow contains a material to be incinerated at delivery levels that vary over time, comprising:

a single insulated vessel, a partition separating said vessel into first and second compartments, each of said compartments having an opening and including a combustion chamber and a thermal storage medium separating said combustion chamber and said opening, said thermal storage media of said first and second compartments being mounted on first grid-work proximate the bottom of said vessel, beneath said combustion chambers, said partition further defining a passage between the combustion chambers of said first and second compartments, a swirl tube mounted in said passage between said combustion chambers, a bypass system including an opening in said vessel and a bypass thermal storage medium separating said opening from said combustion chambers, said bypass thermal storage medium being mounted on second grid-work above said combustion chambers, valving connected to said openings for directing the effluent flow into one of said first and second openings and directing the products of incineration of the effluent to flow out of the other of said first and second openings, said valving being adapted to reverse said flow direction between said first and second openings and to direct the effluent into said bypass while reversing said flow direction, a controller for monitoring the temperature of the effluent entering the incinerator, the temperature of said products of incineration exiting the incinerator, the rate of change of said temperatures and the concentration of the material to be incinerated in the effluent, and for using information resulting from said monitoring to control said valving to reverse said flow direction so as to optimize the efficacy of said incinerator for the differing levels of delivery of the effluent, an exhaust fan for drawing the effluent into said vessel and expelling said products of incineration therefrom, a purging system connected to said valving, including:

recirculation ductwork for receiving a portion of said expelled products of incineration and directing them to purge said one of said thermal recovery media and its associated combustion chamber during said reversing, and an exhaust pressure balance damper for receiving said expelled products of incineration and regulating their pressure in said recirculation ductwork so as to purge said one of said thermal recovery media and its associated combustion chamber within a set period of time, a valve connected to said recirculation ductwork and to said valve means, for recirculating a portion of said expelled products of incineration to said exhaust fan in addition to said products of incineration so as to permit acceleration of said exhaust fan before said products of incineration are provided to said valving to flush said chamber, first and second essentially identical burners for heating said combustion chambers of said first and second compartments respectively, a gas train, first and second fuel pipes connected to said gas train and to said first and second burners, respectively, said first and second fuel pipes being essentially identical so as to provide essentially identical fuel flows to said burners and thereby cause said burners to burn at essentially identical energy input levels, a flame safeguard unit which will alarm if any abnormal condition appears at either burner, and a pair of thermocouples mounted to monitor the temperature of each of said combustion chambers and connected to said controller, said controller operable to calculate a real-time average temperature, and to use said real-time average temperature to control said burners.

16. A method of incinerating an effluent, comprising the steps of:

passing the effluent through a first thermal recovery medium to preheat the effluent, causing said preheated effluent to burn in a combustion chamber, passing said preheated effluent through a swirl tube in a partition in said combustion chamber, passing the effluent through a second thermal recovery medium to recover heat from the burnt effluent, and reversing the flow of the effluent after said heat is recovered, the effluent being passed through a bypass system during said step of reversing.

17. The method of claim 16 including, during said step of reversing, flushing said first thermal recovery medium with said burnt effluent, and regulating said pressure of said burnt effluent to flush said first medium within a set period of time.

18. A method of incinerating an effluent containing a material to be incinerated at delivery levels that vary over time, comprising the steps of:

passing the effluent through a first thermal recovery medium to preheat the effluent, causing said preheated effluent to burn in a combustion chamber, passing the effluent through a second thermal recovery medium to recover heat from the burnt effluent, monitoring the temperature of the effluent entering the first thermal recovery medium, the temperature of said burnt effluent, the rate of change of said temperatures and the concentration of the material to be incinerated in the effluent, and using information resulting from said monitoring to determine when to reverse the flow direction of the effluent so as to optimize performance of said incineration for the differing levels of delivery of the effluent.

19. A method of incinerating an effluent, comprising the steps of:

drawing the effluent through a first thermal recovery medium to preheat the effluent, with an exhaust fan, causing said preheated effluent to burn in a combustion chamber, drawing the burnt effluent through a second thermal recovery medium, with said exhaust fan, to recover heat from the burnt effluent, reversing the flow between the two media after recovering said heat, providing flushing gas to said exhaust fan for a brief interval to permit its acceleration to a higher level of flow, and thereafter, during said step of reversing, flushing said first thermal recovery media with said flushing gas by drawing it through said first medium with said accelerated fan.

20. A method of regeneratively incinerating an effluent in a vessel comprising the steps of:

(a) passing untreated effluent into said vessel and then through a first thermal recovery medium to preheat the effluent;

(b) heating the effluent in a first combustion chamber;

(c) passing heated effluent through an opening in a partition separating said first combustion chamber from a second combustion chamber;

(d) heating the effluent in the second combustion chamber;

(e) passing the effluent through a second thermal recovery medium to recover heat from the effluent and then passing the effluent out of said vessel; and (f) at a selected time, shifting the flow of effluent through said vessel, said flow shift including (i) bypassing said first thermal recovery medium for a first time interval by passing untreated effluent into said combustion chambers without passing said effluent through either of said thermal recovery media and (ii) thereafter reversing said flow of effluent in steps (a) through (e) so that untreated effluent entering said vessel will pass initially into said vessel and through said second thermal recovery medium.

21. A method as in claim 20 wherein said effluent flow shift step includes passing clean gas through said first thermal recovery medium during said bypass step so as to purge untreated effluent from said first thermal recovery medium.

22. A method as in claim 20 wherein said bypass step includes passing untreated effluent through a bypass thermal recovery medium to preheat said untreated effluent 4 prior to entry of said effluent into said combustion chambers.

* * * * *

UNITED STATES PATENT AND TRADEMARK OFFICE

CERTIFICATE OF CORRECTION

PATENT NO. : 5,163,829

DATED : Nov. 17, 1992

INVENTOR(S) : Henry N. Wildenberg

It is certified that error appears in the above-indentified patent and that said Letters Patent is hereby corrected as shown below:

Column 6, line 46, "120000" should be --12000--.
Column 7, line 17, "10" should be --110--.
Column 9, line 57, delete "5" at the end of the line.
Column 14, line 12, "112" should be --12--.
Column 16, line 35, "chamber" should be --chambers--.
Column 17, line 15, "time.." should be --time.--.
Column 20, line 28, delete "4" before "prior".

Signed and Sealed this

Fifth Day of July, 1994

*Attest:*

Bruce Lehman

BRUCE LEHMAN

*Attesting Officer*

*Commissioner of Patents and Trademarks*